US007708114B2

(12) United States Patent
Shaya

(10) Patent No.: US 7,708,114 B2
(45) Date of Patent: May 4, 2010

(54) SOUND-ATTENUATING MUFFLER HAVING REDUCED BACK PRESSURE

(76) Inventor: Zvi Shaya, 40 Huzot Ha Yozer St., Ashkelon (IL)

( * ) Notice: Subject to any disclaimer, the term of this patent is extended or adjusted under 35 U.S.C. 154(b) by 0 days.

(21) Appl. No.: 12/170,443

(22) Filed: Jul. 10, 2008

(65) Prior Publication Data

US 2010/0006370 A1 Jan. 14, 2010

(51) Int. Cl.
*F01N 1/08* (2006.01)
*F01N 1/02* (2006.01)

(52) U.S. Cl. ..... 181/268; 181/272; 181/275

(58) Field of Classification Search ..... 181/268, 181/269, 272, 275, 282, 249, 251, 255, 257, 181/264

See application file for complete search history.

(56) References Cited

U.S. PATENT DOCUMENTS

| | | | | | |
|---|---|---|---|---|---|
| 2,035,923 | A * | 3/1936 | Scarritt | ..... | 181/255 |
| 2,150,768 | A * | 3/1939 | Holbrook | ..... | 181/275 |
| 2,205,899 | A * | 6/1940 | Chipley | ..... | 181/269 |
| 2,213,614 | A * | 9/1940 | Scarritt | ..... | 181/255 |
| 2,239,549 | A * | 9/1941 | Chipley | ..... | 181/269 |
| 2,520,756 | A * | 8/1950 | Bryant | ..... | 181/269 |
| 2,828,830 | A * | 4/1958 | Clark | ..... | 181/275 |
| 3,168,162 | A * | 2/1965 | Clary et al. | ..... | 181/246 |
| 3,989,121 | A * | 11/1976 | Bergson et al. | ..... | 181/272 |
| 4,108,276 | A * | 8/1978 | Hall et al. | ..... | 181/256 |
| 4,147,230 | A * | 4/1979 | Ormond et al. | ..... | 181/231 |
| 4,341,284 | A * | 7/1982 | Moore et al. | ..... | 181/272 |
| 4,574,914 | A * | 3/1986 | Flugger | ..... | 181/268 |
| 4,580,657 | A * | 4/1986 | Schmeichel et al. | ..... | 181/255 |
| 4,809,812 | A * | 3/1989 | Flugger | ..... | 181/268 |
| 4,909,347 | A * | 3/1990 | Wang | ..... | 181/272 |
| 5,123,502 | A * | 6/1992 | Flugger | ..... | 181/264 |
| 5,321,215 | A * | 6/1994 | Kicinski | ..... | 181/211 |
| 5,444,197 | A * | 8/1995 | Flugger | ..... | 181/264 |
| 6,116,376 | A * | 9/2000 | Chu | ..... | 181/256 |
| 6,116,377 | A * | 9/2000 | Dugan | ..... | 181/272 |
| 6,241,044 | B1 * | 6/2001 | Nishiyama et al. | ..... | 181/272 |
| 6,286,623 | B1 | 9/2001 | Shaya | | |
| 6,776,257 | B1 | 8/2004 | Shaya | | |
| 7,219,764 | B1 * | 5/2007 | Forbes | ..... | 181/270 |
| 2006/0054384 | A1 * | 3/2006 | Chen | ..... | 181/272 |

* cited by examiner

*Primary Examiner*—Edgardo San Martin
(74) *Attorney, Agent, or Firm*—Mark M. Friedman

(57) ABSTRACT

The present invention relates to an improvement muffler that includes an improved inlet configuration having first and second sequential chambers with a perforated central pipe passing longitudinally through a central region of both chambers for directing the exhaust gases into the third chamber in which the deflection element is deployed. Additionally, the partition separating the first and second chamber has a hole that enables some of the gas to pass from the first chamber into the second chamber not through the central pipe.

7 Claims, 6 Drawing Sheets

SOUND-ATTENUATING MUFFLER HAVING REDUCED BACK PRESSURE

FIELD AND BACKGROUND OF THE INVENTION

The present invention relates to sound-attenuating mufflers for internal combustion engines and, more particularly, to sound-attenuating mufflers generating reduced back pressure.

Numerous muffler constructions have been proposed for the attenuation of the sound component of an exhaust gas stream from an internal combustion engine. The present invention is an improvement to the low back-pressure sound-attenuating mufflers of U.S. Pat. Nos. 6,286,623 and 6,776,257 to the present inventor and incorporated herein by reference.

The low back-pressure sound-attenuating mufflers of U.S. Pat. Nos. 6,286,623 and 6,776,257 are well suited for sports cars.

There is therefore a need for a low back-pressure sound-attenuating muffler having a lower decibel output than the previous mufflers so as to be usable on regular passenger vehicles.

SUMMARY OF THE INVENTION

The present invention is a low back-pressure sound-attenuating muffler having a lower decibel output than the previous mufflers so as to be usable on regular passenger vehicles.

According to the teachings of the present invention there is provided, a muffler for an internal combustion engine comprising: (a) a housing having an inlet end with an inlet opening formed for a flow of exhaust gases into the housing and an outlet end with an outlet opening formed for a discharge of exhaust gases from the housing; (b) a first chamber and a second chamber sequentially arranged within the housing; (c) a perforated pipe passing longitudinally through a central region of both the first and the second chambers such that the perforated pipe extends partially into the first chamber, extends a full length of the second chamber; wherein the perforations allow the exhaust gases to enter the perforated pipe so as to be directed through an interior of the perforated pipe and into the third chamber and a partition separating the first and the second chambers includes a hole that enables some of the exhaust gases to pass from the first chamber into the second chamber without passing through the central perforated pipe.

According to a further teaching of the present invention, the perforated pipe has a diameter that is 105%-110% of the diameter of the inlet opening.

According to a further teaching of the present invention, an upstream end of the perforated pipe is partially sealed.

According to a further teaching of the present invention, an upstream end of the perforated pipe is 60%-80% open.

According to a further teaching of the present invention, perforations in the perforated pipe extending partially into the first chamber cover 25%-35% of the surface of the perforated pipe and, perforations in the perforated pipe extending the full length of the second chamber cover 60%-75% of the surface of the perforated pipe.

According to a further teaching of the present invention, there is also provided: (d) a third chamber containing a deflection element, the perforated t0 pipe extending so as to open at its downstream end into a third chamber, thereby directing the exhaust gases toward the deflection element; and (e) a fourth chamber configured to channel the flow of gas to the outlet opening.

According to a further teaching of the present invention, the deflection element is a hollow pyramid having interior surfaces and exterior surfaces joining at a first end to form a pyramidal apex, the pyramidal apex pointing toward the inlet end of the muffler and extending at a second end to form an open base interconnected to a partition separating the third and the fourth cambers.

According to a further teaching of the present invention, the deflection element is a dome-shaped partition having an exterior surface, a first end of the exterior surface pointing toward the inlet end of the muffler, and widening out at a second end to form a base interconnected to a partition separating the third and the fourth cambers.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is a low back-pressure sound-attenuating muffler having a lower decibel output than the previous mufflers so as to be usable on regular passenger vehicles.

The principles and operation of low back-pressure sound-attenuating muffler according to the present invention may be better understood with reference to the drawings and the accompanying description.

Figure 1:
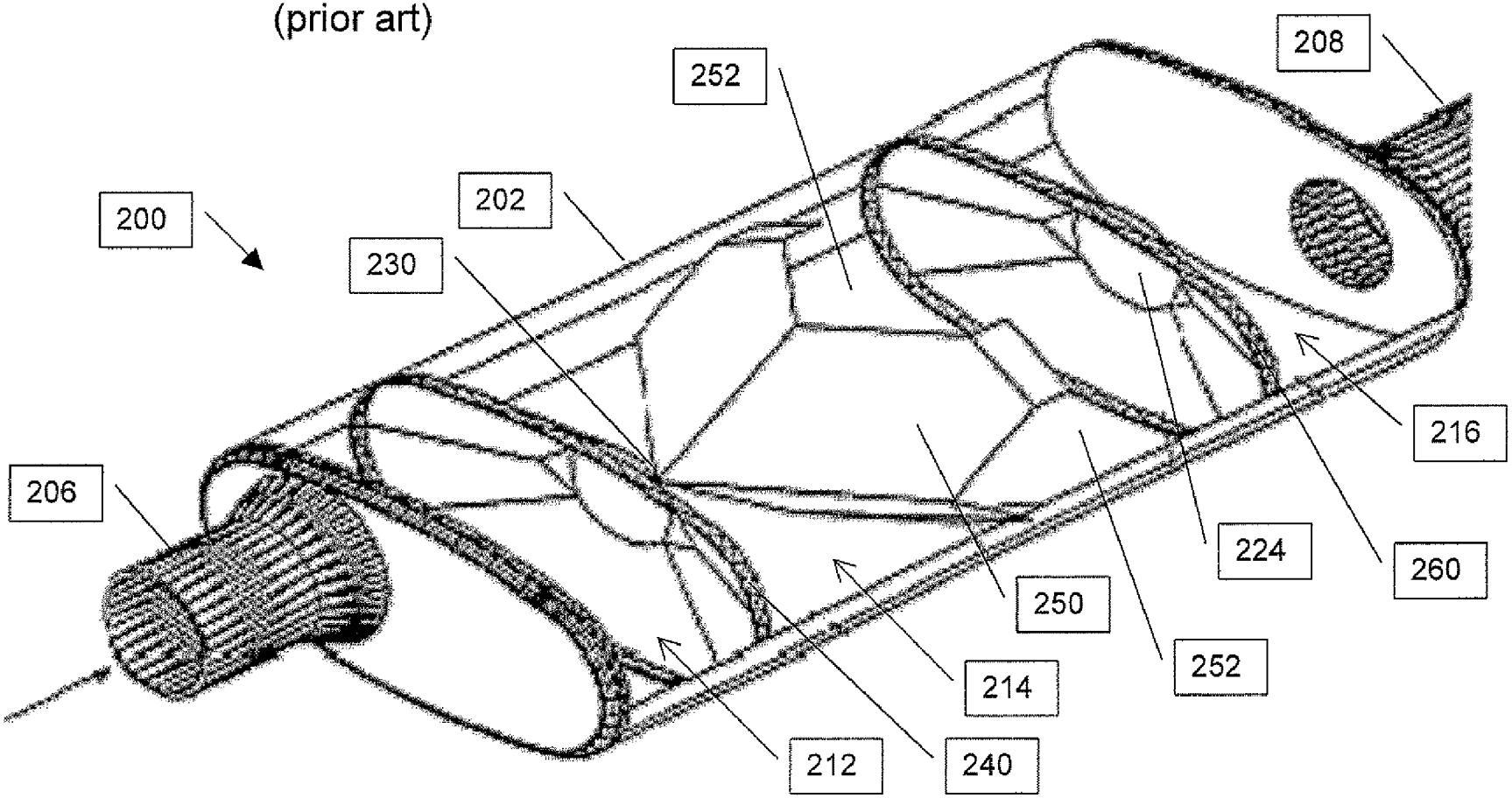
FIG. 1 (prior art)
FIG. 1 is a perspective, cut open view of the muffler of U.S. Pat. No. 6,286,623.

By way of introduction reference is made to the prior art low back-pressure sound-attenuating mufflers of U.S. Pat. Nos. 6,286,623 and 6,776,257 to the present inventor FIG. 1 shows a cut open view of the muffler 200 of U.S. Pat. No. 6,286,623. The muffler 200 consists of an elongated housing 202 having an inlet 206 for introducing the exhaust gases, an outlet 208 for discharging the exhaust gases, a pyramidal partition 250 and converging partitions 240 and 260.

The exhaust gases from the internal combustion engine are introduced into the muffler 200 through the inlet 206. The exhaust gases enter the housing 202 and flow longitudinally through the length of muffler 200 passing first through chamber 212. The exhaust gases exit chamber 212 through an opening in partition 240. Partition 240 is shaped like a funnel (or truncated pyramid), disposed such that the opening in the partition 240 centers the flow of exhaust gases within housing 202. The flow exhaust gases then enters the second chamber 214 and encounters the apex 230 of pyramidal partition 250, causing the flow to be deflected along the exterior faces of pyramidal partition 250 and towards the interior surface of the outer wall of housing 202.

The exhaust gases flow through the four spaces 252 formed by the rugose base of the pyramidal partition 250. A substantial first portion of the exhaust gases continue to flow in the direction of the outlet pipe 208, thereby creating a low pressure region inside the pyramidal partition 250. Consequently, a second portion of the exhaust gases changes direction and enters (is drawn into) the inside region of pyramidal partition 250 before continuing toward the outlet pipe 208. The exhaust gases flow through converging partition 260, which is substantially identical in shape and in disposition to converging partition 240. Thus, the flow of exhaust gases enters the third chamber 216 and is again centered within the housing 202 by the partition outlet 224 before being discharged through outlet pipe 208.

Figure 2:
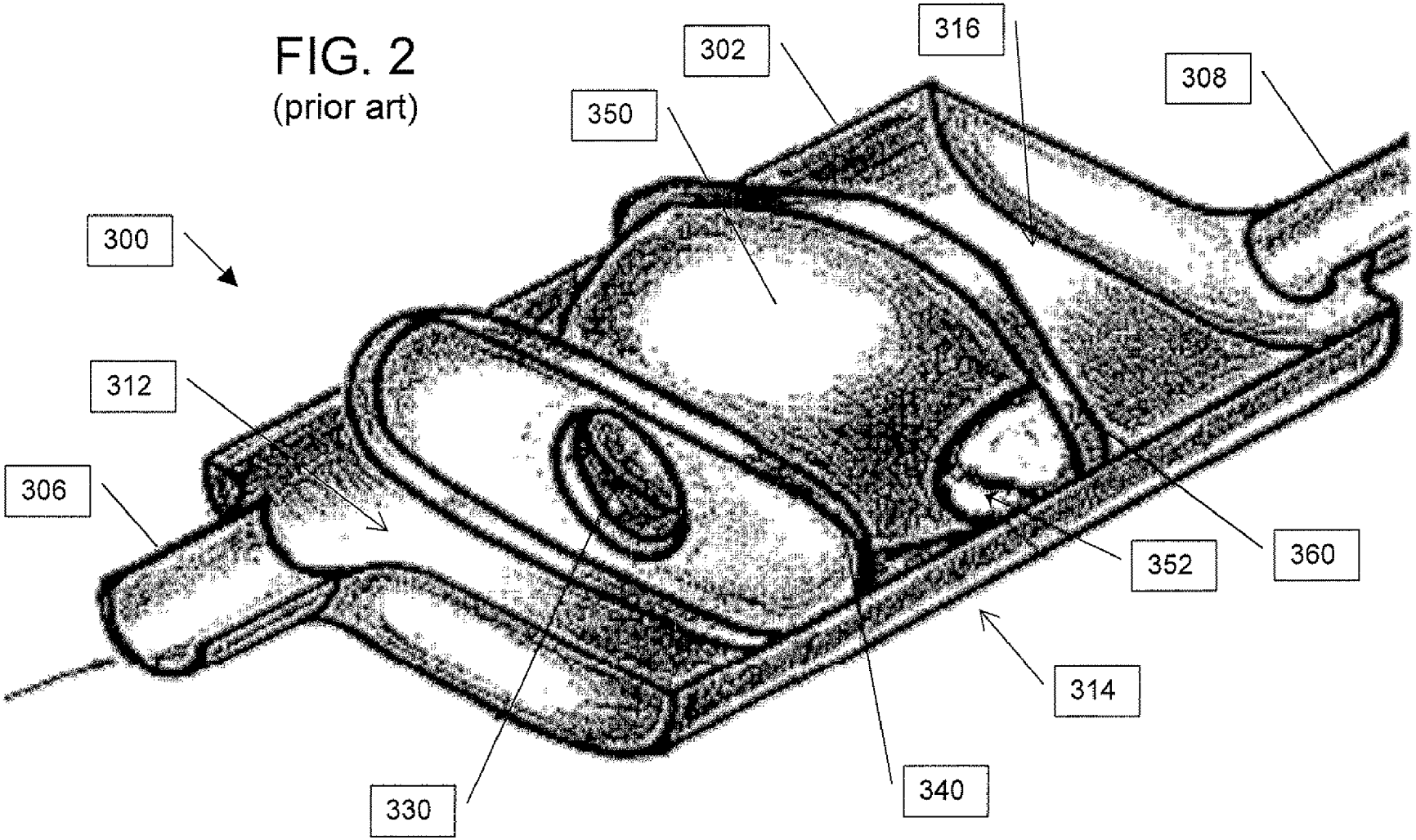
FIG. 2 (prior art)
FIG. 2 is a perspective, cut-open view of the muffler of U.S. Pat. No. 6,776,257.

FIG. 2 shows a perspective, cut-open view of the muffler 300 of U.S. Pat. No. 6,776,257. Muffler 300 includes an elongated housing 302 having an inlet 306 for introducing the exhaust gases, an outlet 308 for discharging the exhaust gases, a main partition 350, and an aligning partition 340.

The exhaust gases from the internal combustion engine are introduced through the inlet 306. The exhaust gases enter housing 302 and flow longitudinally through the length of muffler 300 passing first through chamber 312. The exhaust gases exit chamber 312 through an opening in partition 340. Partition 340 is preferably shaped like a funnel (or truncated pyramid), and most importantly, is disposed such that the exhaust gas flow is centered within the housing 302 as the exhaust gases enter the second chamber 314 and the flow of exhaust gases encounters the top of domed partition 350, causing the flow to be deflected along the exterior face of domed partition 350.

The exhaust gases flow through openings 352 in the sides of domed partition 350 Openings 352 are preferably disposed on opposite sides of domed partition 350.

Subsequently, the exhaust gases continue to flow in the direction of S outlet pipe 308, thereby creating a low pressure region inside domed partition 350. Consequently, a portion of the exhaust gases change direction and enter (are drawn into) the inside of domed partition 350 before continuing in the direction of outlet pipe 308. The exhaust gases flow through converging partition 360, which is advantageously similar in shape and in disposition to converging partition 340, and enter the third chamber 316 before being discharged through outlet pipe 308.

Generally speaking, the embodiments of U.S. Pat. Nos. 6,286,623 and 6,776,257 as briefly described above include an inlet chamber, a deflection chamber in which a deflection element is deployed and an outlet chamber.

The present invention relates to an improvement that may be used to benefit both of the previous muffler embodiments described above. Specifically, the present invention includes an improved inlet configuration having first and second sequential chambers with a perforated central pipe passing longitudinally through a central region of both chambers for directing the exhaust gases into the third chamber in which the deflection element is deployed. Additionally, the partition separating the first and second chamber has a hole that enables some of the gas to pass from the first chamber into the second chamber not through the central pipe.

Described below are two exemplary embodiments of the present inventor The embodiment of FIGS. 3 and 4 relates to a muffler combining the features of the present invention with the pyramidal partition deflection element of U.S. Pat. No. 6,286,623. The embodiment of FIGS. 5 and 6 relates to a muffler combining the features of the present invention with the domed partition deflection element of U.S. Pat. No. 6,776,257

Figure 3:
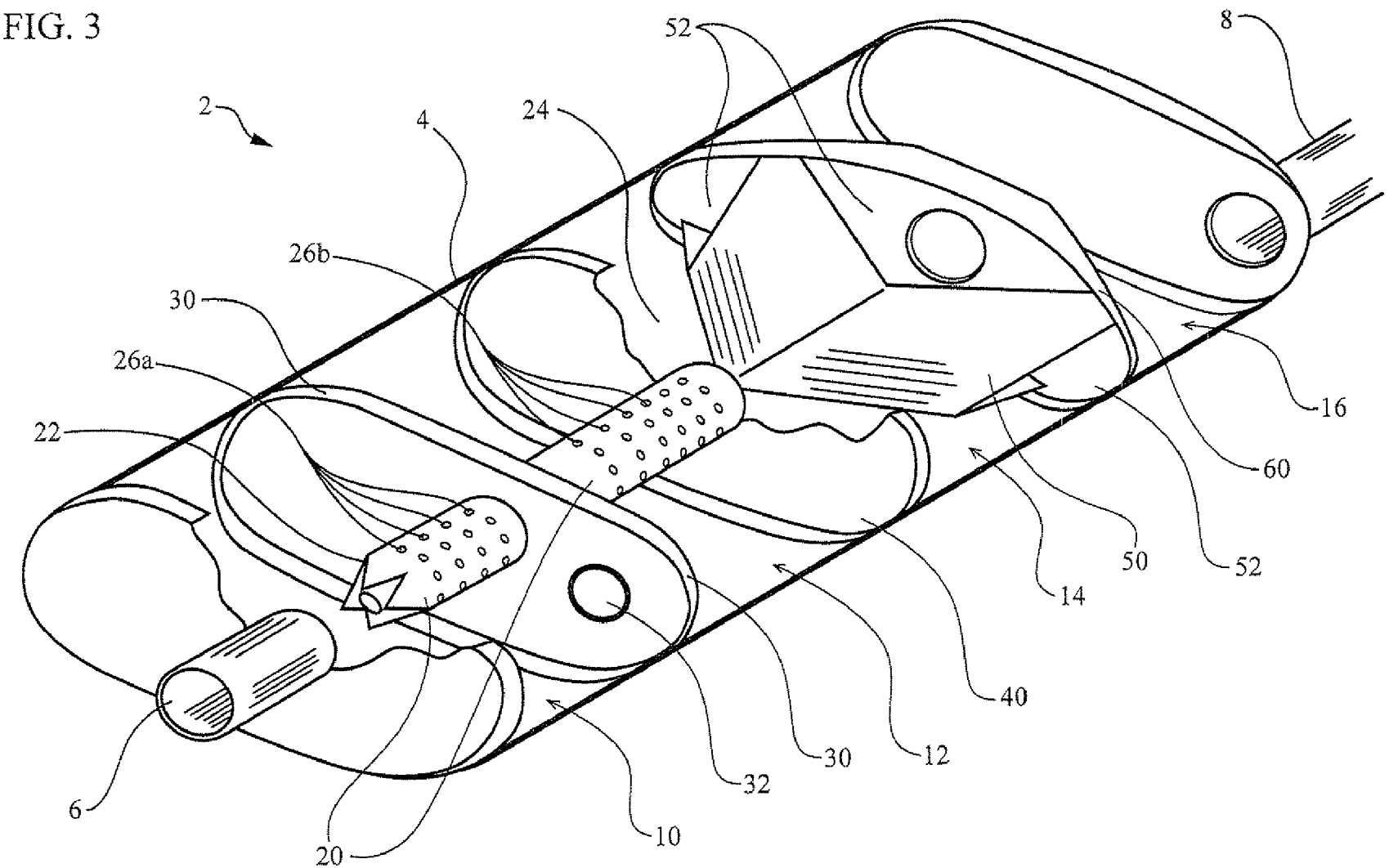
FIG. 3 is a perspective, cut-open view of a first preferred embodiment of a muffler constructed and operational according to the teachings of the present invention.
Figure 4:
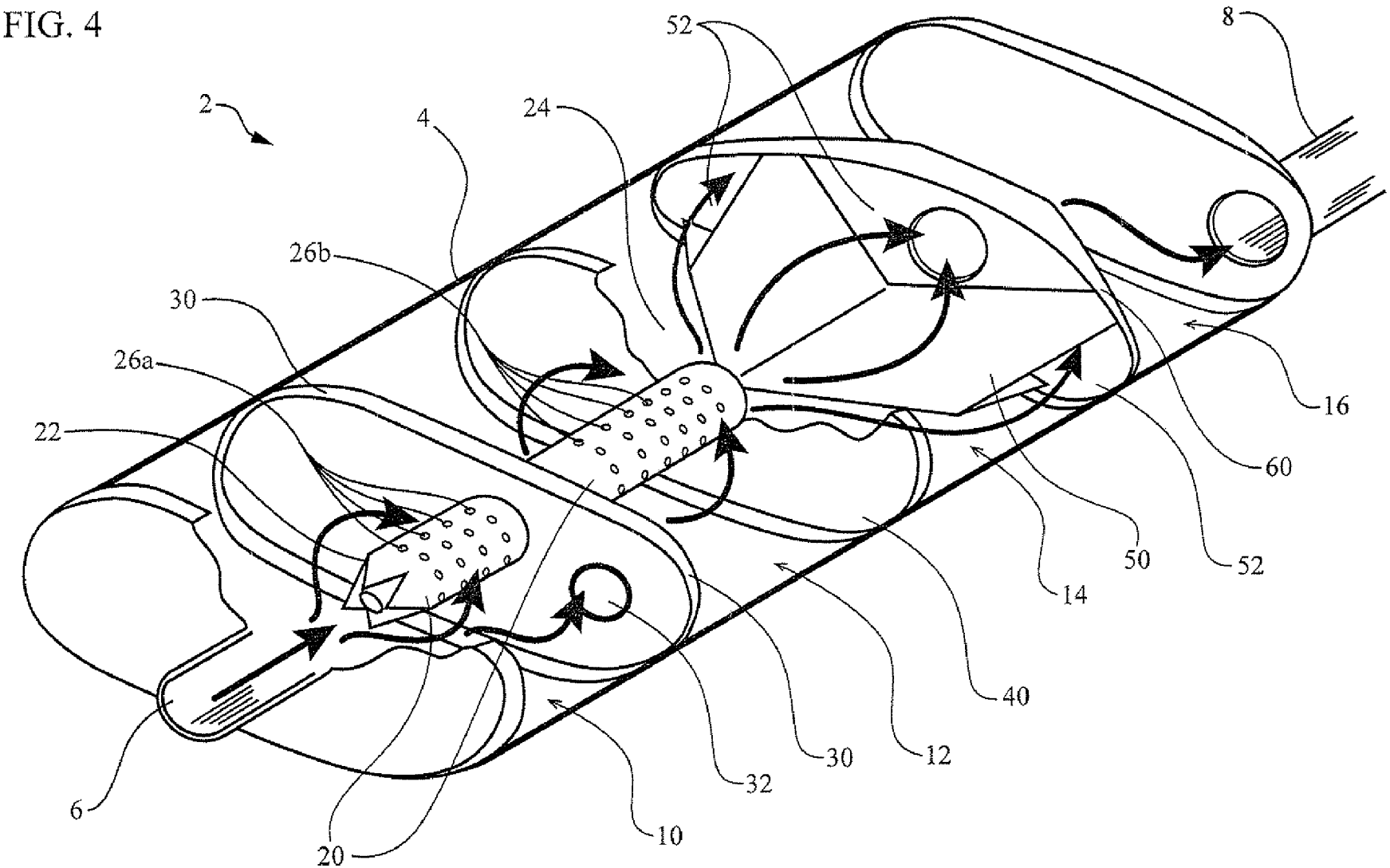
FIG. 4 is a perspective, cut-open view showing the flow path of exhaust gases through the embodiment of FIG. 3.

Referring now to the drawings, FIGS. 3 and 4 illustrate a muffler 2 generally defined by a housing 4. An inlet 6 is provided in the inlet end of the muffler for introducing exhaust gases into the first chamber 10. The improved inlet configuration has the first chamber 10 and a second chamber 12 sequentially arranged within muffler 2. A perforated pipe 20, with its upstream end 22 partially sealed, passing longitudinally through a central region of both the first 10 and the second 12 chambers such that perforated pipe 20 extends partially into the first chamber 10 and extends the full length of the second chamber 12. Perforated pipe 20 extends at its downstream end 24 through partition 40 and opens into the third chamber 14. The perforations **26*a* allow the exhaust gases to enter the perforated pipe 20 from the first chamber 10, while perforations 26*b* allow the exhaust gases to enter the perforated pipe 20 from the second chamber 12. Once the exhaust gases enter perforated pipe 20 they are directed through the interior of perforated pipe 20 and into the third chamber 14. As illustrated here, the perforations 26 are formed over a predetermined percentage of the surface of pipe 20**.

The partition 30 separating the first and second chambers includes a preferably round hole 32 that enables some of the gas to pass from the first chamber 10 into the second chamber 12 without passing through the central perforated pipe 20. Exhaust gases that enter the second chamber 12 then pass through the perforations 26 in the section of perforated pipe 20 deployed in second chamber 12. It will be appreciated that hole 32 may be of substantially any suitable size and shape.

With this basic understanding of the general structure of the first two chambers of the muffler, it will be appreciated that inlet 6 is configured for attachment to the exhaust pipe of the vehicle on which the muffler is deployed and therefore may vary in diameter depending on the specifications of the of the vehicle manufacturer. It will be appreciated that inlet 6 may be configured as more that one inlet pipe. It will be readily understood that in such an embodiment, the percentages listed herebelow are applied to the combined size of all inlet pipes. Similarly, the outlet pipe 8 may be configured as more that one outlet pipe and the percentages listed herebelow are applied to the combined size of all outlet pipes.

In order for the muffler of the present invention to perform at an optimum level, perforated pipe 20 has a diameter that is 100%-130% of the diameter of inlet pipe 6. It will be appreciated that perforated pipe 20 may be implemented as more than one perforated pipe as long as the ratio of 100%-130% of the diameter of inlet pipe 6 is maintained. The upstream end 22 of the perforated pipe 20 is partially sealed so as to be 60%-80% open. The perforation holes in the perforated pipe 20 may range from 15 mm-55 mm in diameter. Perforations **26*a* cover between 20%-40% of the surface of perforated pipe 20, while perforations 26*b* cover 50%-90% of the surface of perforated pipe 20. Hole 32 configured in partition 30 has a diameter that is 60%-80% of the diameter of perforated pipe 20. It will be appreciated that hole 32 may be implemented as a plurality of holes configured in partition 30, however, the combined size of the opening still falls within the range of 60%-80% of the diameter of perforated pipe 20. Further, embodiments in which the second chamber 12 is subdivided into a number of chambers through which perforated pipe 20 passes are within the scope of the present invention. It should be noted that these specifications apply to the embodiment of the present invention described bellow with regard to FIGS. 5** and 6, as well as any muffler constructed and operational according to the teachings of the present invention.

Similar to the muffler of FIG. 1, the flow of exhaust gases is centered within the housing 4 as the exhaust gases leaves the downstream end 24 of the perforated pipe 20, enters the third chamber 14. The flow of exhaust gases encounters the apex of pyramidal partition 50, which is spaced a distance of 20 mm-60 mm from the downstream end 24 of the perforated pipe 20, causing the flow to be deflected along the exterior faces of pyramidal partition 50 and towards the interior surface of the outer wall of housing 4.

The exhaust gases flow then through the four spaces 52 formed by the rugose base of the pyramidal partition 50. A substantial first portion of the exhaust gases continue to flow in the direction of the outlet pipe 120, thereby creating a low pressure region inside the pyramidal partition 150. Consequently, a second portion of the exhaust gases changes direction and enters (is drawn into) the inside region of pyramidal partition 50 before continuing toward the outlet pipe 8. The exhaust gases flow through partition 60 and is again centered within the housing 100 as the exhaust gases enter the fourth chamber 16 before being discharged through outlet pipe 8, formed in the outlet end of the muffler.

The arrows in FIG. 4 illustrate the flow path of the exhaust gases through this embodiment of the muffler of the present invention.

Figure 5:
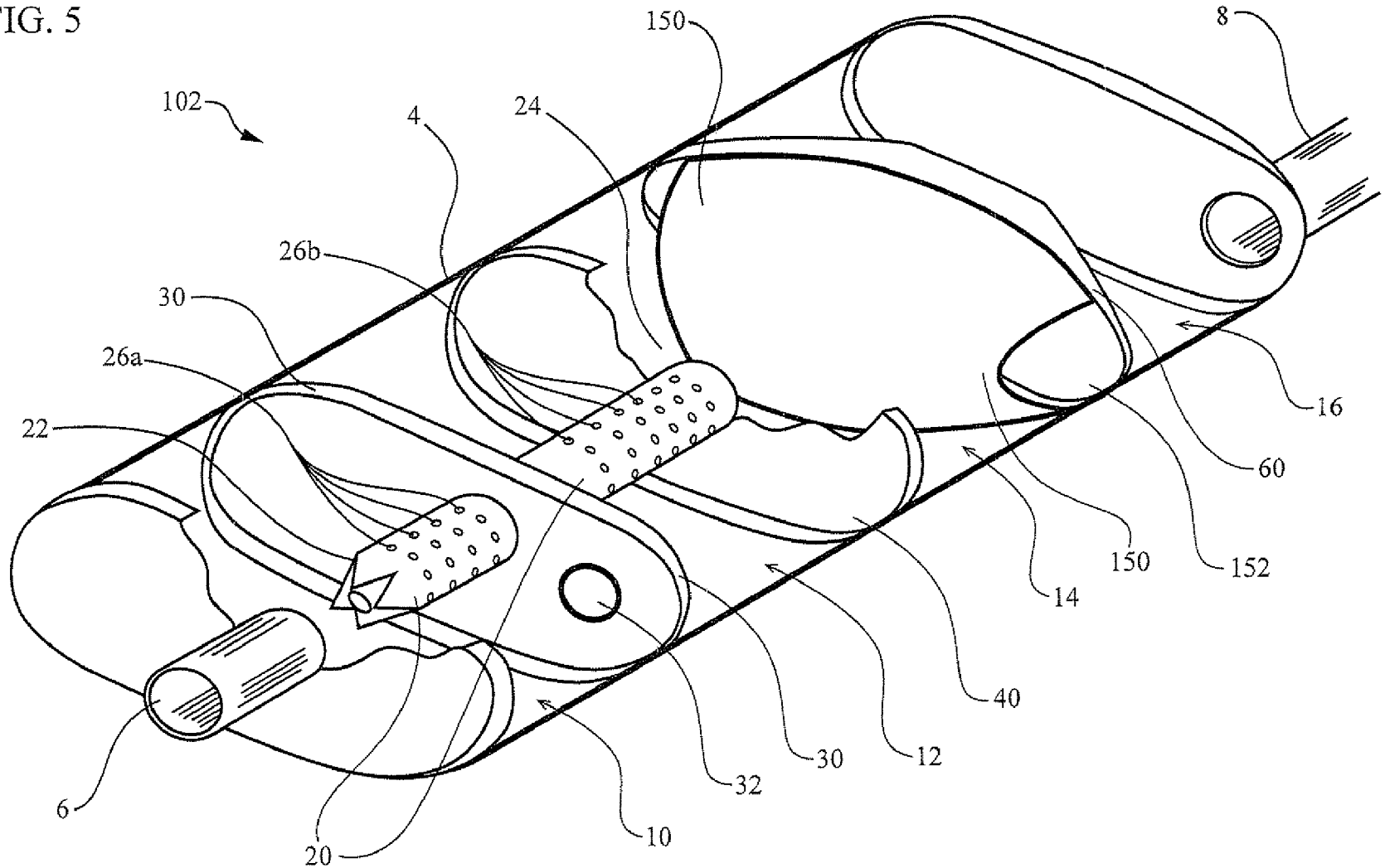
FIG. 5 is a perspective, cut-open view of a second preferred embodiment of a muffler constructed and operational according to the teachings of the present invention.
Figure 6:
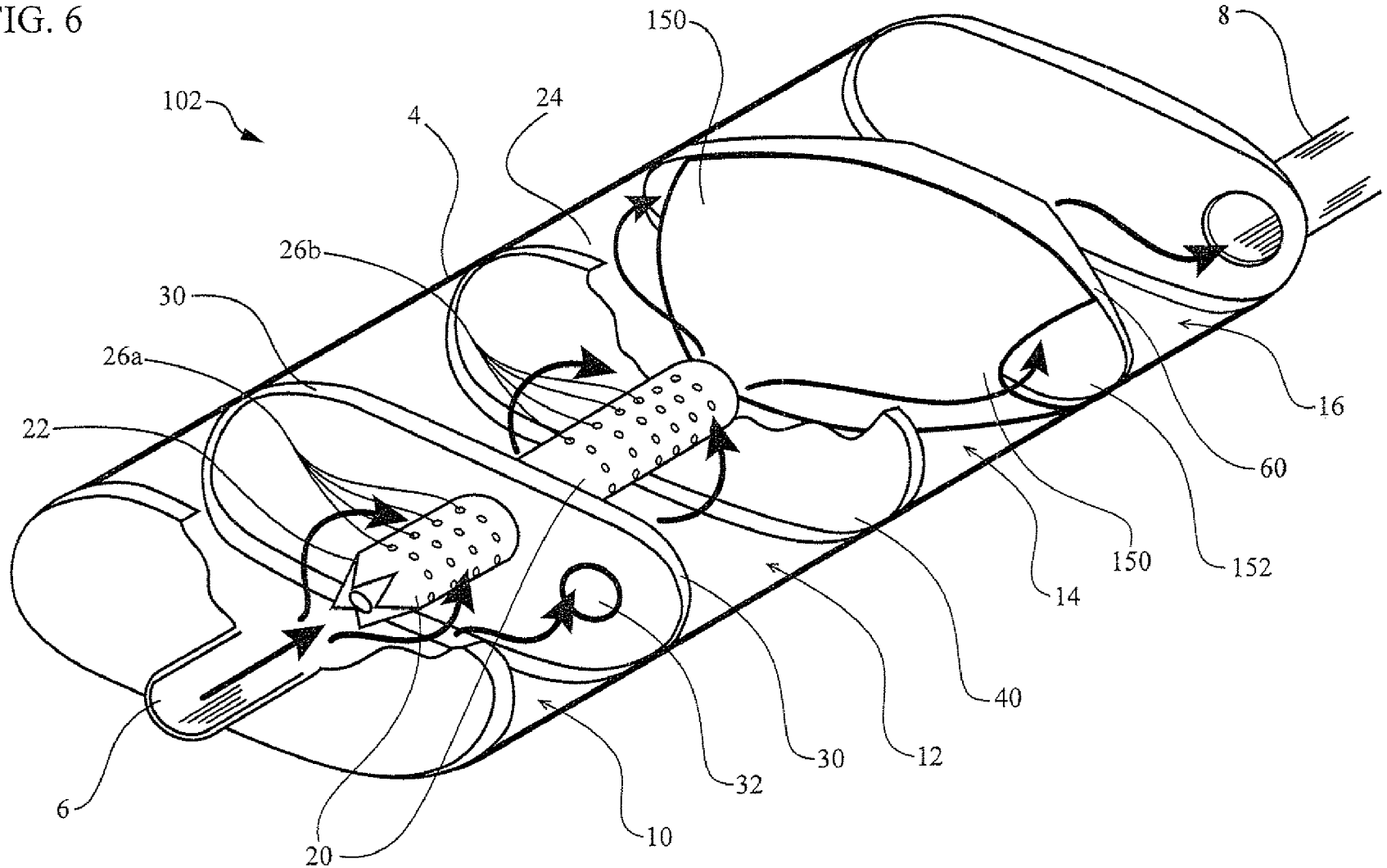
FIG. 6 is a perspective, cut-open view showing the flow path of exhaust gases through the embodiment of FIG. 5.

FIGS. 5 and 6 illustrate a muffler 102 generally defined by a housing 4, which includes an inlet configuration similar to the embodiment of FIGS. 3 and 4, therefore, the same reference numerals are used here to refer to corresponding components. It will be appreciated that the specifications relating to component size detailed above apply equally here as well.

An inlet 6 is provided in the inlet end of the muffler for introducing exhaust gases into the first chamber 10. The improved inlet configuration of this embodiment also has the first chamber 10 and a second chamber 12 sequentially arranged within muffler 102. A perforated pipe 20, with its upstream end 22 sealed, passing longitudinally through a central region of both the first 10 and the second 12 chambers such that perforated pipe 20 extends partially into the first chamber 10 and extends the full length of the second chamber 12. Perforated pipe 20 extends at its downstream end 24 through partition 40 and opens into the third chamber 14. The perforations 26 allow the exhaust gases to enter the perforated pipe 20 so as to be directed through the interior of perforated pipe 20 and into the third chamber 14.

The partition 30 separating the first and second chambers includes a preferably round hole 32 that enables some of the gas to pass from the first chamber 10 into the second chamber 12 without passing through the central perforated pipe 20. Exhaust gases that enter the second chamber 12 then pass through the perforations 26 in the section of perforated pipe 20 deployed in second chamber 12. It will be appreciated that in this embodiment as well, hole 32 may be of substantially any suitable size and shape.

Similar to the muffler of FIG. 2, the exhaust gas flow is centered within the housing 4 as the exhaust gases leaves the downstream end 24 of the perforated pipe 20, and enters the third chamber 14 and the flow of exhaust gases encounters the top of domed partition 150, causing the flow of exhaust gases to be deflected along the exterior face of domed partition 150. Dome-shaped partition 150 having an exterior surface, a first end of the exterior surface points toward the inlet end of the muffler, and widening out at a second end to form a base, said dome-shaped partition having at least two partition openings disposed between said first end and said second end of said exterior surface The exhaust gases flow through openings 152 in the sides of domed partition 150. Openings 152 are preferably disposed on opposite sides of domed partition 150.

Subsequently, the exhaust gases continue to flow in the direction of outlet pipe 8 formed in the outlet end of the muffler, thereby creating a low pressure region inside domed partition 150. Consequently, a portion of the exhaust gases change direction and enter (are drawn into) the inside of domed partition 150 before continuing in the direction of outlet pipe 8. The exhaust gases flow through an opening (not shown) partition 160, and enter the fourth chamber 16 before being discharged through outlet pipe 8.

The arrows in FIG. 6 illustrate the flow path of the exhaust gases through this embodiment of the muffler of the present invention.

It will be appreciated that the above descriptions are intended only to serve as examples and that many other embodiments are possible within the spirit and the scope of the present invention.

What is claimed is:

1. A muffler for an internal combustion engine comprising:

(a) a housing having an inlet end with at least one inlet opening formed for a flow of exhaust gases into said housing and an outlet end with an outlet opening formed for a discharge of exhaust gases from said housing;

(b) a first chamber, a second chamber, a third chamber and a fourth chamber sequentially arranged within said housing;

(c) a perforated pipe passing longitudinally through a central region of both said first and said second chambers such that said perforated pipe extends partially into said first chamber, extends a full length of said second chamber and terminates at a partition separating said second and third chambers;

(d) said third chamber containing a deflection element, said perforated pipe configured so as to open at its downstream end into said third chamber, thereby directing said exhaust gases toward said deflection element; and (e) a fourth chamber configured to channel a flow of gas to said outlet opening;

wherein said perforations allow said exhaust gases to enter said perforated pipe so as to be directed through an unblocked interior of said perforated pipe and into said third chamber and a partition separating said first and said second chambers includes a hole that enables some of said exhaust gases to pass from said first chamber into said second chamber without passing through said central perforated pipe and all of said exhaust gases pass from said second chamber into said third chamber only through said downstream end of said perforated pipe.

2. The muffler of claim 1, wherein said perforated pipe has a diameter that is 100%-130% of the diameter of said inlet opening.

3. The muffler of claim 1, wherein an upstream end of said perforated pipe is partially sealed.

4. The muffler of claim 3, wherein said upstream end of said perforated pipe is 60%-80% open.

5. The muffler of claim 1, wherein perforations in said perforated pipe extending partially into said first chamber cover 20%-40% of a surface of said perforated pipe and, perforations in said perforated pipe extending said full length of said second chamber cover 50%-90% of said surface of said perforated pipe.

6. The muffler of claim 1, wherein said deflection element is a hollow pyramid having interior surfaces and exterior surfaces joining at a first end to form a pyramidal apex, said pyramidal apex pointing toward said inlet end of the muffler and extending at a second end to form an open base interconnected to a partition separating said third and said fourth cambers.

7. The muffler of claim 1, wherein said deflection element is a dome-shaped partition having an exterior surface, a first end of said exterior surface pointing toward said inlet end of the muffler, and widening out at a second end to form a base interconnected to a partition separating said third and said fourth cambers.

* * * * *